United States Patent [19]

Akright

[11] Patent Number: 4,835,997

[45] Date of Patent: Jun. 6, 1989

[54] TWO-WAY ROTARY LOCK

[75] Inventor: Michael V. Akright, Lake Villa, Ill.

[73] Assignee: A. L. Hansen Manufacturing Company, Gurnee, Ill.

[21] Appl. No.: 589,650

[22] Filed: Mar. 14, 1984

[51] Int. Cl.[4] ..... E05B 63/00; E05C 3/06

[52] U.S. Cl. ..... 70/141; 292/216; 292/244

[58] Field of Search ..... 70/141; 292/216, 244, 292/213, DIG. 40, DIG. 21

[56] References Cited

U.S. PATENT DOCUMENTS

| | | | |
|---|---|---|---|
| 3,705,505 | 12/1972 | Landow et al. | 292/216 |
| 3,905,627 | 9/1975 | Fujita | 292/216 |
| 4,007,955 | 2/1977 | Kobayashi | 292/216 |
| 4,123,096 | 10/1978 | Ardizio | 292/216 |
| 4,208,837 | 6/1980 | Black | 292/216 |
| 4,427,223 | 1/1984 | Godec et al. | 292/244 |
| 4,457,146 | 7/1984 | Weinerman | 292/216 |

*Primary Examiner*—Richard E. Moore
*Assistant Examiner*—Vinh Luong
*Attorney, Agent, or Firm*—William Brinks Olds Hofer Gilson & Lione, Ltd.

[57] ABSTRACT

A two-way rotary lock is disclosed of a type suitable for use in locking a sliding door of an automative vehicle in either an open or closed position. This lock includes a lock body that defines first and second recesses positioned on opposed sides of the lock body to receive first and second strikers mounted to the side frames which define the door opening. A latch plate is rotatably mounted within the lock body, and this latch plate defines first and second tangs. Pivotal movement of the latch plate causes the first and second tangs to block the respective recesses and thereby capture the respective strikers in place. A single lock mechanism is used to secure the latch plate in position, and appropriate linkages allow either an inside handle or an outside handle to be used to release the latch plate and thereby release a captured one of the strikers from the lock body.

25 Claims, 6 Drawing Sheets

FIG. 1
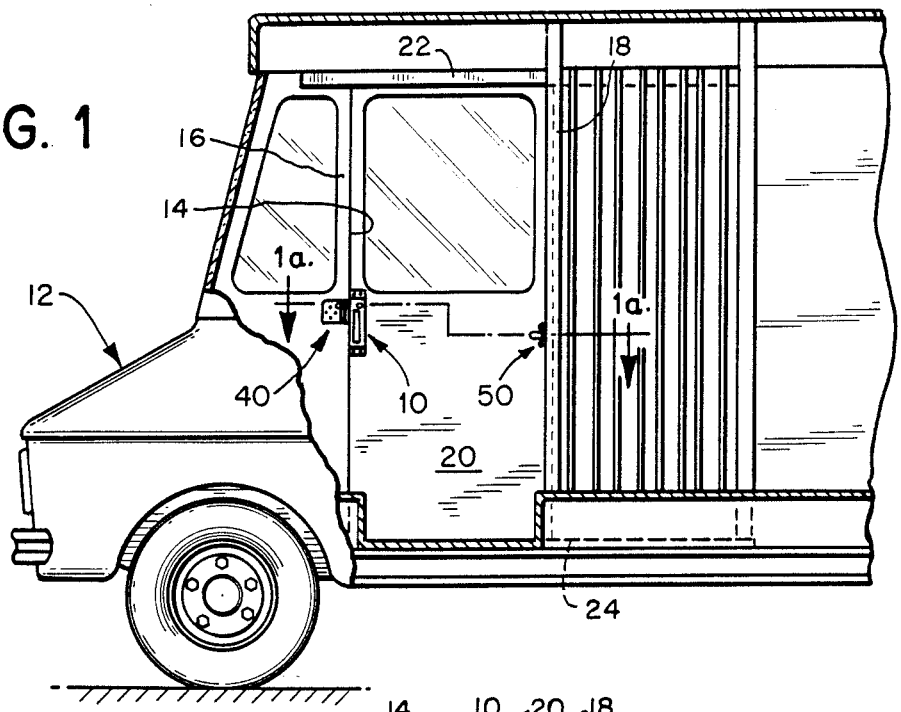
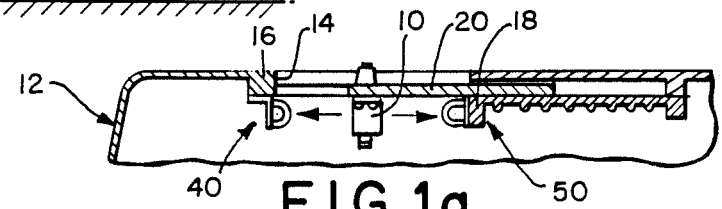
FIG. 1a
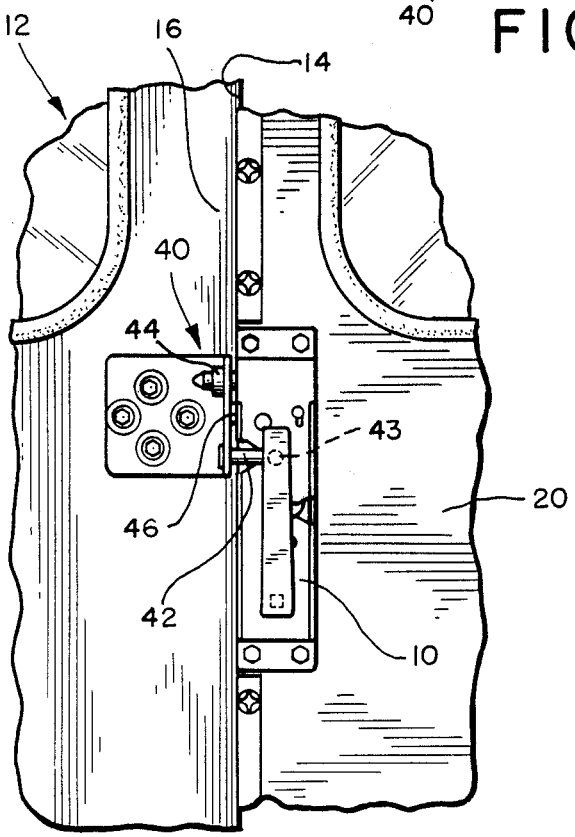
FIG. 1b
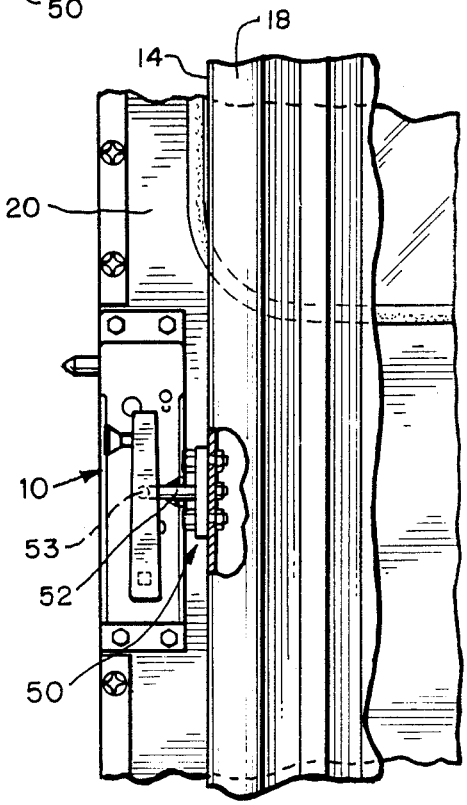
FIG. 1c

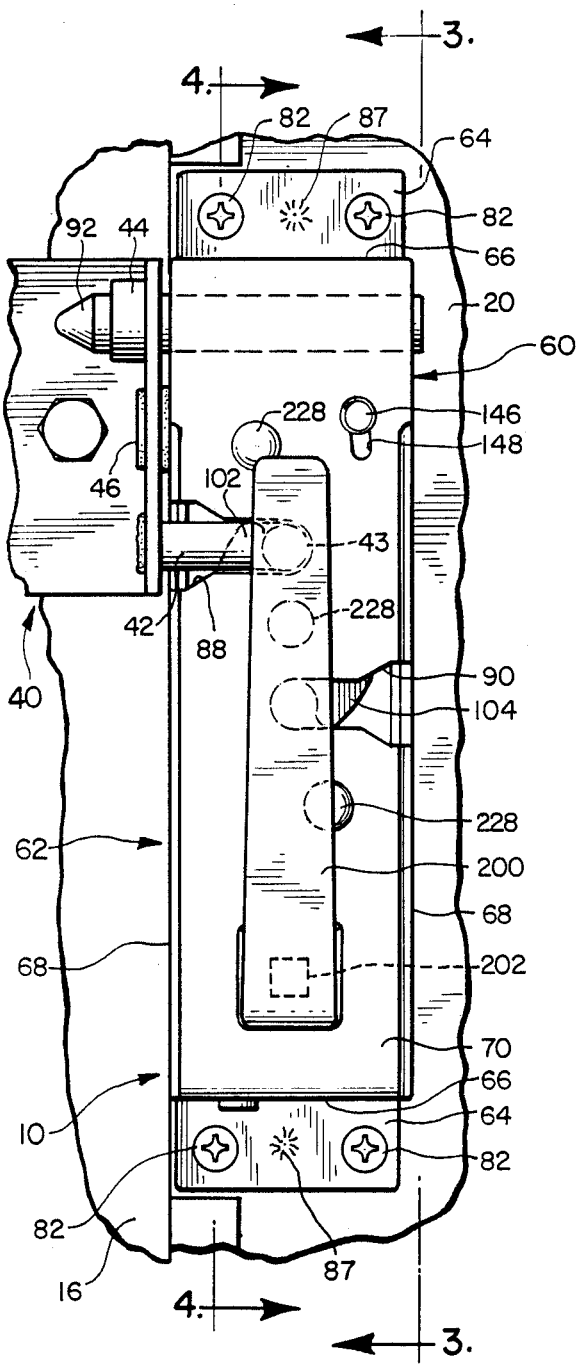
FIG. 2
FIG. 3
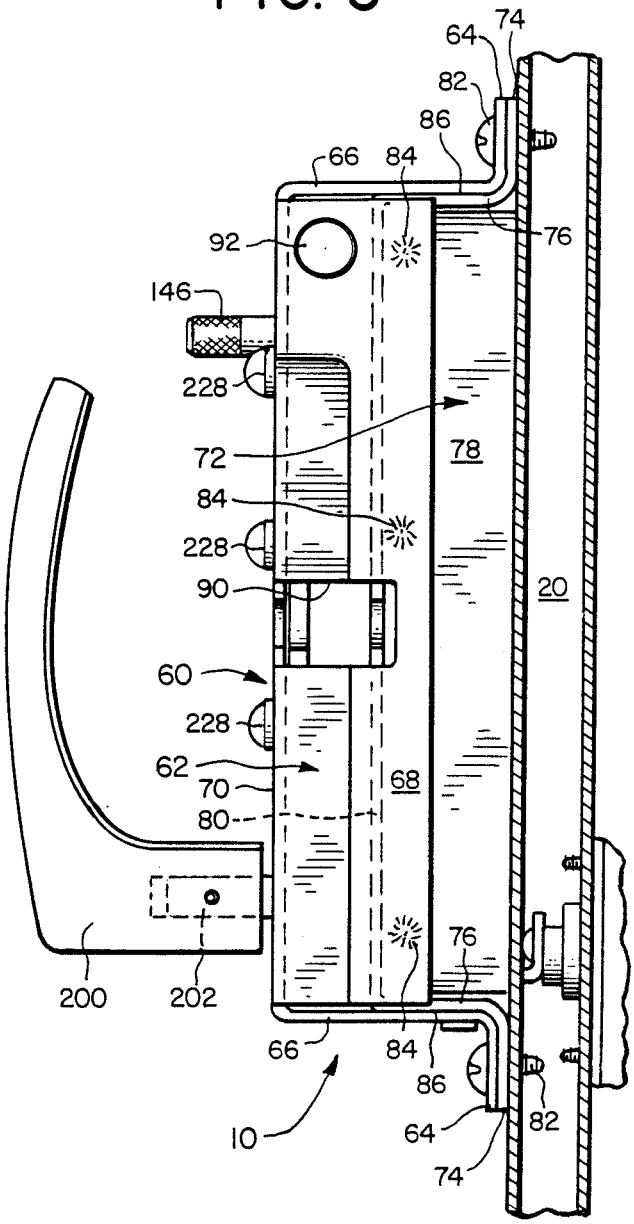

FIG. 4
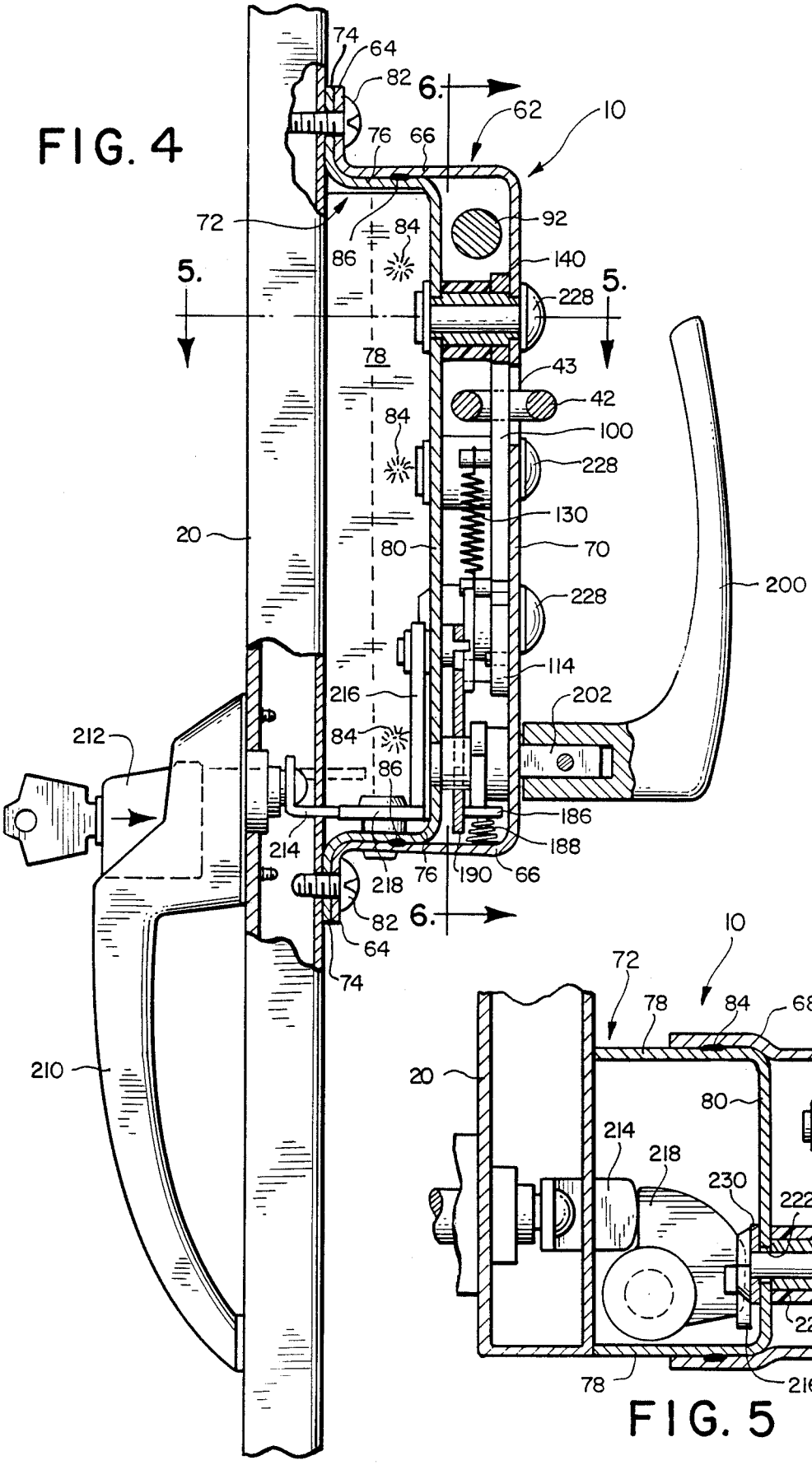
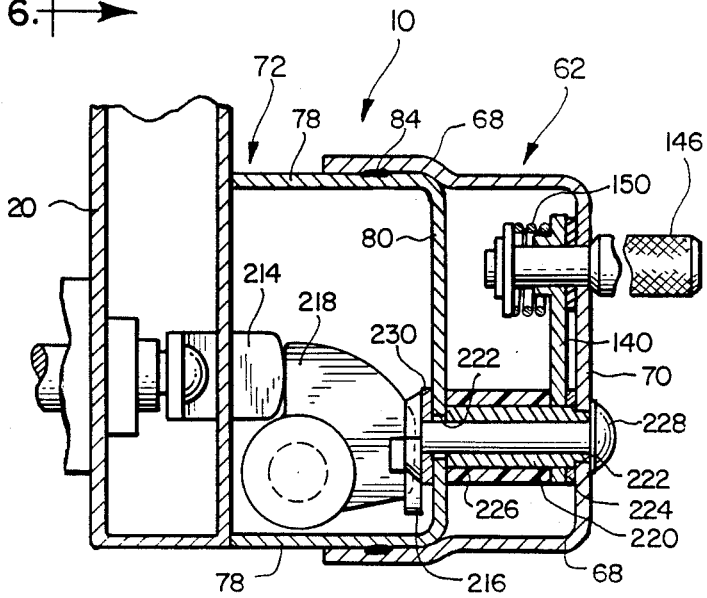
FIG. 5

TWO-WAY ROTARY LOCK

BACKGROUND OF THE INVENTION

The present invention relates to an improved two-way rotary lock for use with an automotive vehicle of the type which includes a sliding door that moves in a door frame between open and closed positions.

Such sliding doors are used, for example, in delivery vans to provide ready access to and from the van. Typically, such a door will be latched closed while the van is in motion and then latched open when the door is used to make deliveries. Preferably, such a lock should provide a positive latching action and should be sturdy enough to withstand large forces tending to open the door.

One prior art approach to the problem of latching such a sliding door is to provide a latch which defines opposed spring loaded projections that protrude away from the lock body and are positioned to fit into and engage recessed strikers positioned in the door frame. This prior art latch does not provide a positive locking action, because both of the projections are spring loaded into engagement with the respective strikers. Accelerations and shocks associated with vehicle travel can cause the projections to bounce out of engagement with the strikers, thereby releasing the door. Thus, a need presently exists for an improved two-way lock which will provide higher strength and more reliable locking action for a sliding door in an automotive vehicle.

SUMMARY OF THE INVENTION

The present invention is directed to a two-way rotary lock which largely overcomes the afore-mentioned disadvantages.

According to this invention, a lock is provided which comprises a lock body that defines first and second recesses positioned on opposed sides of the lock body to receive first and second strikers, respectively. A first tang is positioned within the lock body along with means for rotatably mounting the first tang to the lock body such that the first tang pivots to capture a portion of the first striker which is passed through the first recess into the interior of the lock body. A second tang is also positioned wihtin the lock body, along with means for rotatably mounting the second tang to the lock body such that the second tang pivots to capture a portion of the second striker which is passed through the second recess into the interior of the lock body. Means are provided for automatically locking the first and second tangs in place to capture the first and second strikers, respectively, in the lock body, as well as for selectively, manually overriding the locking means to release the first and second strikers from the lock body.

In the preferred embodiment described below, the first and second tangs are defined by a common latch plate which is mounted to the lock body to pivot about an axis, and the first and second tangs are positioned on opposed sides of the axis such that the latch plate pivots in a predetermined direction when it locks both the first and second strikers. This arrangement allows the use of a single keeper plate to secure the latch plate in position in order to capture either one of the two strikers.

As will be apparent from the following detailed description, the preferred embodiment of the present invention provides the important advantage of a positive locking action by which a rod-shaped striker is securely captured in place within the lock body. The preferred embodiment described below is a high strength lock which provides excellent resistance against either transverse or longitudinal forces tending to move the door from its locked position. Thus, this invention can be used to provide a high degree of safety in an automotive sliding door. Furthermore, the preferred embodiment described below is narrow in transverse dimension (parallel to the direction of movement of the door). For this reason, the lock allows the door to be opened widely, thereby making optimum use of the transverse dimension of the available door opening.

The invention itself, together with further objects and attendant advantages, will best be understood by reference to the following detailed description, taken in conjunction with the accompanying drawings.

BRIEF DESCRIPTION OF THE DRAWINGS

FIG. 1 is an inside elevational view of a portion of a truck body on which a preferred embodiment of the lock of this invention is mounted.

FIG. 1*a* is a sectional view taken along line 1*a*—1*a* of FIG. 1.

FIG. 1*b* is an enlarged detail view corresponding to FIG. 1 showing the door of the truck body latched in a closed position.

FIG. 1*c* is an enlarged detail view corresponding to FIG. 1 showing the door latched in an open position.

FIG. 2 is a front elevational view of the lock of FIG. 1.

FIG. 3 is a side elevational view taken along line 3—3 of FIG. 2.

FIG. 4 is a sectional view taken along line 4—4 of FIG. 2.

FIG. 5 is a sectional view taken along line 5—5 of FIG. 4.

DETAILED DESCRIPTION OF THE PRESENTLY PREFERRED EMBODIMENTS

Figure 6:
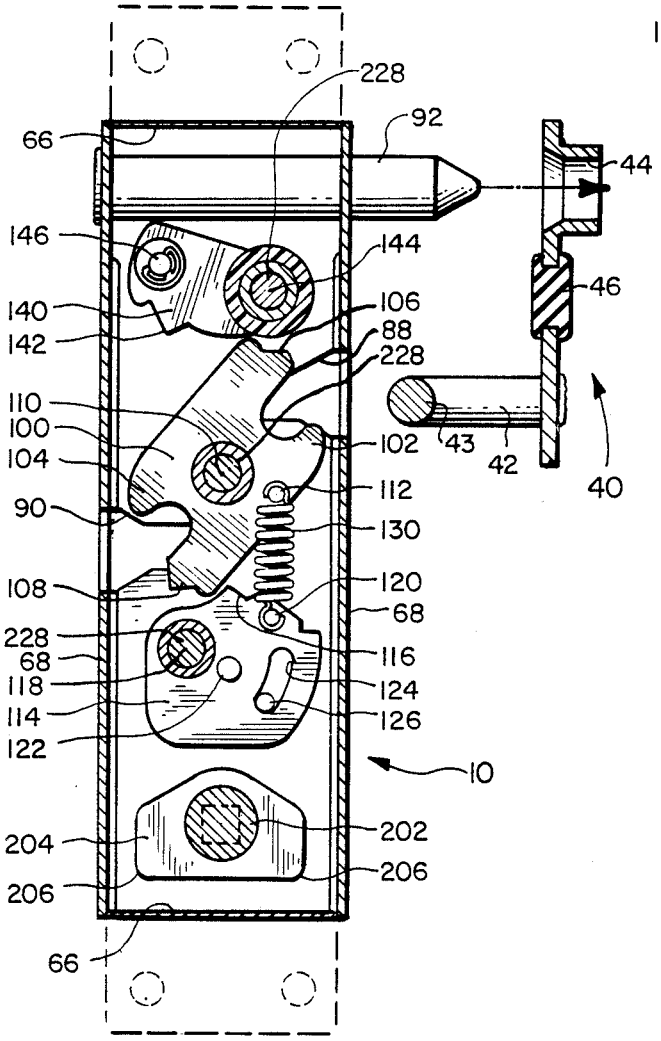
FIG. 6 is a sectional view taken along line 6—6 of FIG. 3 showing the lock in an unlatched position.

Turning now to the drawings, various views of a lock 10 which incorporates the presently preferred embodiment of this invention are shown. FIGS. 1, 1*a*, 1*b* and 1*c* are general layout drawings showing the manner in which the lock 10 can be mounted in place. In these drawings, reference numeral 12 is used to refer generally to a truck body, such as a body for a step van. This truck body 12 defines a door opening 14 which is bounded at its lateral sides by a front side frame 16 and a rear side frame 18. A door 20 is mounted in an upper guide 22 and a lower guide 24 so as to slide between the open position shown in FIG. 1*b* and the closed position shown in FIG. 1c. It should be clearly understood that the truck body 12 and its component elements are shown merely to illustrate the environment of the present invention, and that they do not per se form part of this invention. For this reason, details of the truck body 12 will not be described in greater detail. Suitable truck bodies can be obtained, for example, from Union City Body Company Incorporated of Union City, Ind.

As shown in FIGS. 1 and 1b, a front striker plate assembly 40 is mounted to the front side frame 16. This front striker plate assembly 40 includes a striker 42 which is generally U-shaped and defines a central bight section 43. The front striker plate assembly 40 also defines an opening 44 and an elastomeric bumper 46. As shown in FIG. 2, the front striker plate assembly 40 can be securely bolted in place in a fixed, rigid position on the front side frame 16.

As shown in FIGS. 1 and 1c, a rear striker plate assembly 50 is fixedly secured to the rear side frame 18, as for example by means of bolts. This rear striker plate assembly 50 includes a striker 52 which defines a central U-shaped bight section 53. Both the striker 42 and the striker 52 are generally rod-shaped in this embodiment and extend away from the respective side frame 16, 18 toward the center of the door opening 14.

As best shown in FIGS. 2–5, the lock 10 includes a lock body or frame 60 which is made up of an outer body section 62 and an inner body section 72. The outer body section 62 defines two opposed mounting flanges 64, two parallel, opposed end plates 66, and two parallel, opposed side plates 68. A top plate 70 extends between the end plate 66 and the side plates 68. In this preferred embodiment, the entire outer body section 62 is bent from a single sheet of low carbon steel.

Similarly, the inner body seciton 72 defines two opposed, coplanar mounting flanges 72 which are connected to two opposed, parallel end plates 76. The end plates 76 are connected to either end of a bottom plate 80. Two opposed parallel side plates 78 are connected to the bottom plate 80 between the end plates 76. As before, the inner body section 72 is in this preferred embodiment folded from a single sheet of low carbon steel.

When fully assembled, the mounting flanges 64 overlap and abut the mounting flanges 74 and the top and bottom plates 70, 80 are oriented parallel to one another. Similarly, the side plates 68, 78 overlap. A plurality of fasteners 82 are used to secure the mounting flanges 64, 74 to the door 20 of the truck body 12. A total of six spot welds 84 secure the side plates 68, 78 together; two spots welds 86 secure the end plates 66, 76 together; and two spot welds 87 secure the mounting flanges 64, 74 together. Once the outer and inner body sections 62, 72 have been spot welded together, they cooperate to form a sturdy, rigid, and strong frame for the lock 10.

The lock body 60 defines front and rear recesses 88, 90, as shown in FIG. 2. These recesses 88, 90 are positioned on the lock body 60 to receive the bight sections 43, 53 of the strikers 42, 52 respectively. Thus, when the door 20 is in the closed position shown in FIG. 1b, the bight section 43 extends into the lock body 60 via the front recess 88. Similarly, when the door 20 is moved to the open position shown in FIG. 1c, the bight seciton 53 of the striker 52 of the rear striker plate assembly 50 protrudes into the lock body 60 via the rear recess 90.

A pin 92 is secured between the side plates 68 of the outer body section 62 so as to extend toward the front striker plate assembly 40. The pin 92 is positioned and sized to fit within the opening 44 defined by the front striker plate assembly 40 to ensure proper alignment between the door 20 and the truck body 12 when the door 20 is in the closed position of FIG. 1b. In this preferred embodiment, the pin 92 is a solid, pointed cylinder formed of a low carbon leaded steel which is welded in place to the side plate 68 remote from the pointed end of the pin 92.

Figure 7:
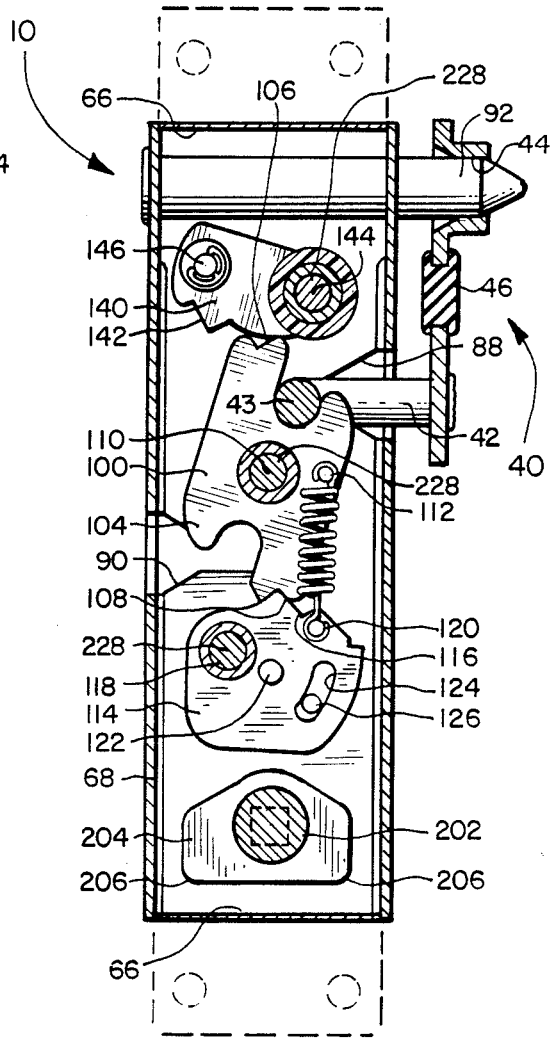
FIG. 7 is a view corresponding to FIG. 6 showing the lock in a secondary latched position.
Figure 8:
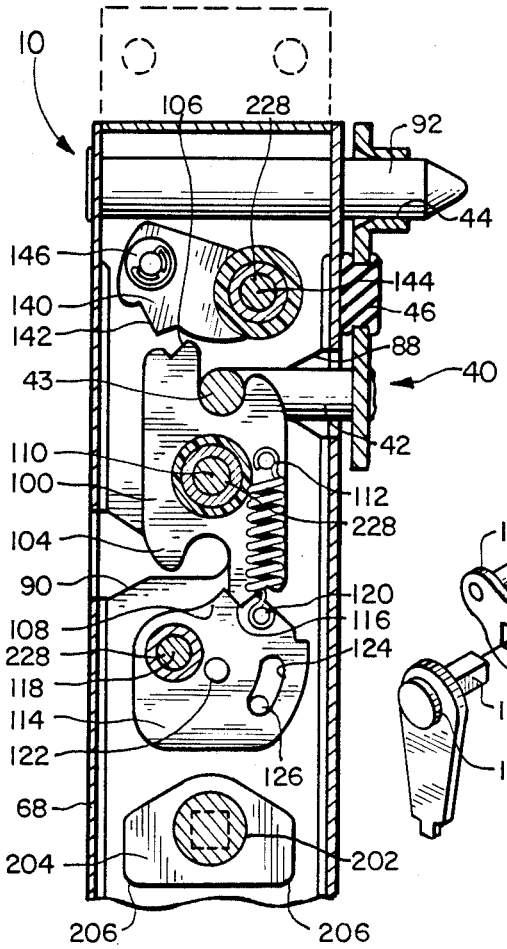
FIG. 8 is a view corresponding to FIG. 6 showing the lock in a fully latched position.

Turning now to FIG. 6–8, a latch plate 100 is pivotably mounted between the top and bottom plates 70, 80. This latch plate 100 defines two tangs 102, 104 as well as two toothed surfaces 106, 108. The entire latch plate 100 pivots in place about a pivot axis 110. The latch plate 100 defines a pin 112 used to secure a spring, as described below.

In addition, a keeper plate 114 is pivotably mounted between the top and bottom plates 70, 80 to rotate about a pivot axis 118. The keeper plate 114 defines a toothed surface 116 shaped to mate with the toothed surface 108 of the latch plate 100. The keeper plate 114 also defines pins 120, 122, as well as an arcuate slot 124. A pin 126 is rigidly secured to the top plate 70 so as to fit within the slot 124 and limit the angular movement of the keeper plate 114 about the pivot axis 118.

A coil spring 130 is mounted between the pins 112, 120 on the latch plate 100 and keeper plate 114, respectively. This coil spring 130 biases the pins 112, 120 together and thereby biases the latch plate 100 and the keeper plate 114 to the position shown in FIG. 6.

As shown in FIG. 5–9, the lock 10 also includes a lock plate 140 which is pivotably mounted between the top and bottom plates 70, 80 to rotate about a pivot axis 144. This lock plate 140 defines a toothed surface 142 positioned and configured to engage the toothed surface 106 of the latch plate 100. A handle 146 is secured to the lock plate 140 so as to protrude out of the top plate 70 via a slot 148 (FIG. 5). This handle 146 is spring biased by a spring 150 inwardly. The handle 146 can be used to manually pivot the lock plate 140 between the unlocked position shown in FIGS. 6–8 and the locked position shown in FIG. 9. The slot 148 is provided with a keyhole shape and the handle 146 is provided with a mating shoulder such that the lock plate 140 cannot be pivoted to the locked position of FIG. 9 unless the handle 146 is moved outwardly, against the bias of the spring 150, prior to moving the handle 146 downwardly, toward the latch plate 100.

FIG. 6–9 show the manner in which the latch plate 100 pivots to capture either the front or rear striker 42, 52. For simplicity, FIGS. 6–9 show the lock engaging only the front striker 42; however, the operation of the lock 10 with the rear striker 52 is identical. In FIG. 6, the latch plate 100 is shown in an open position in which the tangs 102, 104 are not blocking the recesses 88, 90, respectively. FIG. 7 shows the manner in which the bight section 43 of the front striker 42 can fit within the recess 88 and rotate the latch plate 100 about the pivot axis 110 until the toothed surfaces 108, 116 reach a secondary latched position. In this position, the tangs 102, 104 block the recesses 88, 90 in order to capture either the front striker 42 or the rear striker 52 in place. In the position of FIG. 7, the toothed surfaces 108, 116 securely hold the latch plate 100 in place, thereby preventing removal of a captured one of the strikers 42, 52.

As shown in FIG. 8, if either one of the strikers 42, 52 is pushed farther into the lock body 60, the latch plate 100 rotates farther, to a fully latched position in which the latch plate 100 is more completely engaged with the keeper plate 114. When so latched, the captured one of the strikers 42, 52 cannot be removed from the lock body 60 until the keeper plate 114 is rotated clockwise as shown in FIG. 8 out of mechanical engagement with the latch plate 100.

Figure 9:
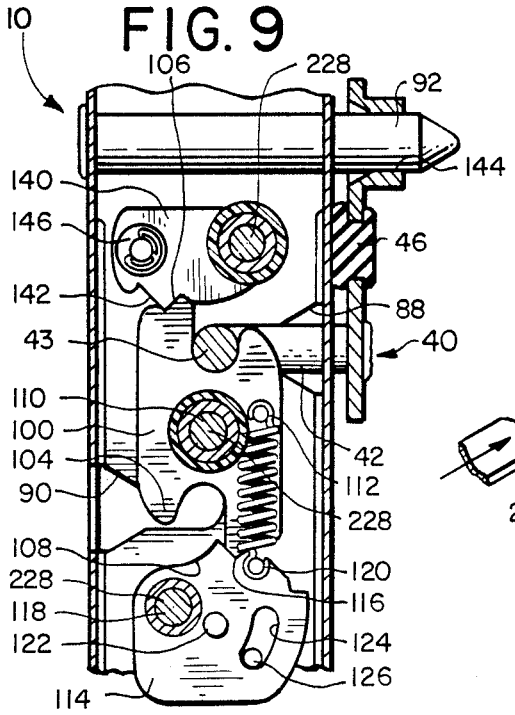
FIG. 9 is a detail view corresponding to FIG. 6 showing the lock in a fully latched and locked position.

The lock plate 140 operates independently of the keeper plate 114 to mechanically engage the latch plate 100. When the lock plate 140 is mechanically engaged with the latch plate 100 as shown in FIG. 9, rotation of the keeper plate 114 will not be sufficient to allow the latch plate 100 to rotate so as to free a captured one of the strikers 42, 52.

When the lock plate 140 is in the unlocked position shown in FIGS. 6–8, a cpatured one of the strikers 42, 52 can be released by pivoting the keeper plate 114 in a clockwise direction as shown in FIGS. 6–9. This can be accomplished either from the inside or the outside of the truck body 12 by suitable linkages.

Figure 10:
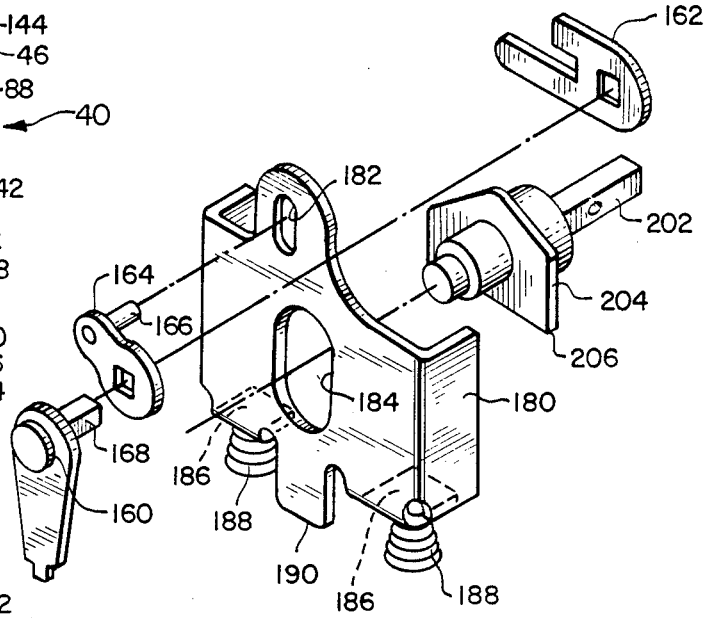
FIG. 10 is an exploded perspective view of portions of the mechanism of the lock of FIG. 1.
Figure 11:
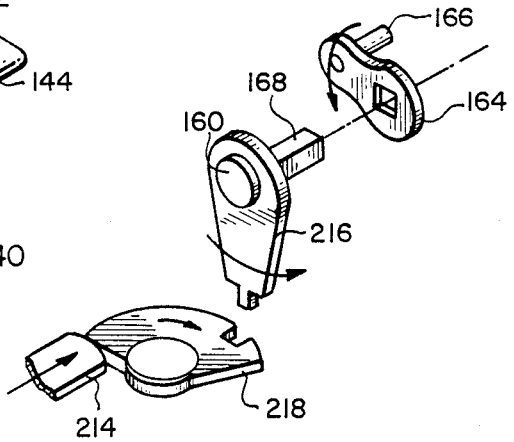
FIG. 11 is an exploded perspective view of additional portions of the mechanism of the lock of FIG. 1.
Figure 12:
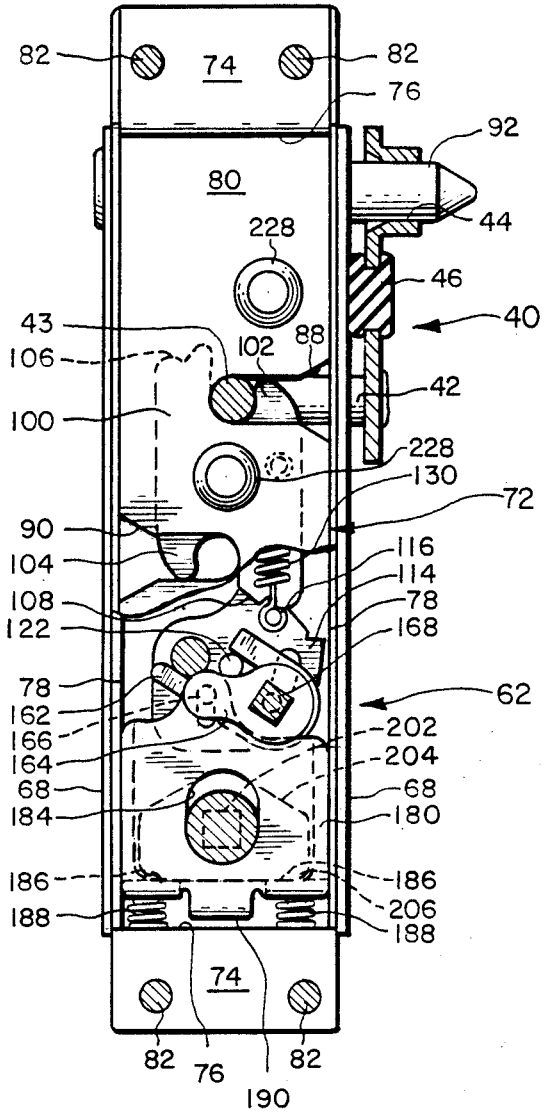
FIG. 12 is a rear view in partial cutaway showing the lock of FIG. 1 in a fully latched position.
Figure 13:
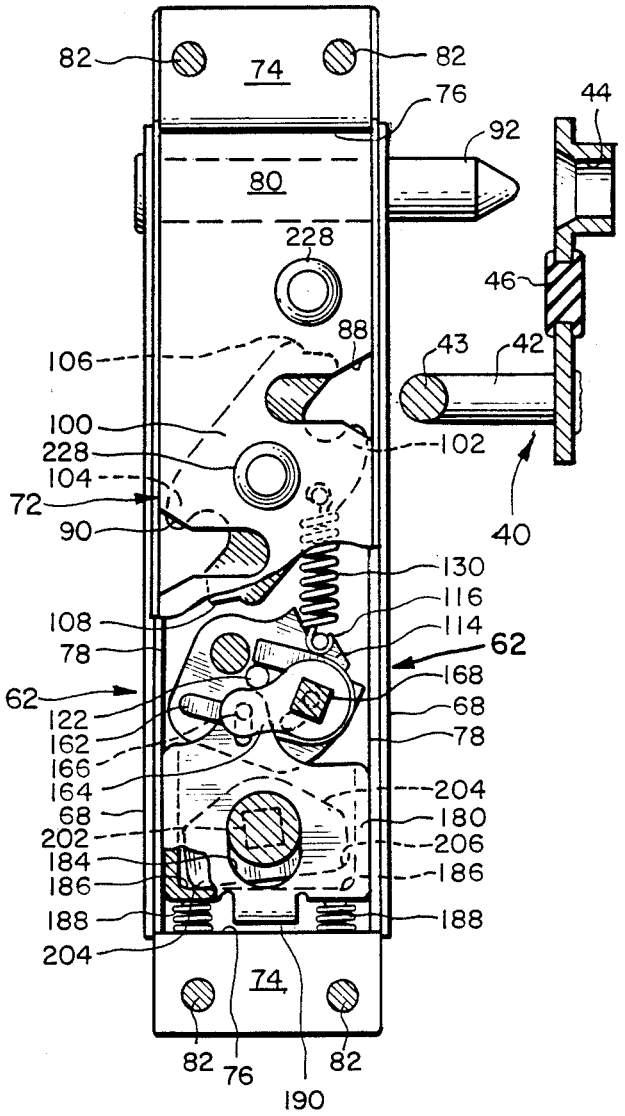
FIG. 13 is a view corresponding to FIG. 12 showing the inside handle pivoted to unlatch the lock.

As shown in FIGS. 4, 10 and 11, in this embodiment these linkages includes a shaft 160 which is pivotably mounted in the bottom plate 80. This shaft 160 defines a square section 168 on which are mounted a fork 162 and a lever arm 164. The fork 162 is shaped and positioned to engage the pin 122 on the keeper plate 114 (FIGS. 12 and 13). The lever arm 164 defines a pin 166 extending parallel to the shaft 160.

As shown in FIGS. 10 and 12–13, a slider 180 is positioned to slide longitudinally within the lock body 60, guided by the side walls 68. As used herein the term "longitudinal" is intended to refer to a direction parallel to the side walls 68, 78. The slider 180 defines a slot 182 positioned to receive the pin 166 of the lever arm 164. In addition, the slider 180 defines a central slot 184, as well as a shelf 186 which extends transversely to the lever arm 164. The portion of the slider 180 farthest from the slot 182 defines a stop 190 positioned to engage the adjacent end plate 66 of the outer body section 62. Thus, the stop 190 limits the sliding movement of the slider 180. A pair of springs 188 are positioned between the shelf 186 and the adjacent end plate 66. These springs 188 bias the slider 180 toward the keeper plate 114.

The lock 10 includes an inside handle 200 which is mounted to a shaft 202 which is pivotably mounted in place to the lock body 60 (FIG. 4). This shaft 202 serves to support a cam plate 204 which defines two cam surfaces 206, each bearing against the shelf 186 at a point opposed to a respective one of the springs 188 (FIGS. 10 and 12–13).

Pivotal movement of the inside handle 200 and the shaft 202 in either direction causes the cam plate 204 to be rotated and the slider 180 to be moved away from the keeper plate 114. When this happens, the slider 180 rotates the shaft 160 via the pin 166 and the lever arm 164 in a counterclockwise direction as shown in FIG. 13. This causes the fork 162 to be rotated in a counterclockwise direction as shown in FIG. 13, thereby causing the pin 122 of the keeper plate 114 to be moved away from the latch plate 100. This causes the keeper plate 114 to be rotated in a clockwise direction as shown in FIG. 13 away from the latch plate 100 and against the spring bias of the spring 130. When the keeper plate 114 is rotated out of mechanical engagement with the latch plate 100, the spring 130 rotates the latch plate 100 from either one of the latched positions shown in FIGS. 7–9 to the unlatched position shown in FIGS. 5 and 13.

In order to open the lock 10 from the outside of the truck body 12, an outside handle 210 is used (FIG. 4). This outside handle 210 includes a push button 212 which operates to move a tab 214 toward and away from the lock 10. The tab 214 can be rotated between an operative position and an inoperative position by means of a key cylinder. When the tab 214 is in the operative position movement of the tab 214 toward the lock 10 causes the tab 214 to abut a sector plate 218 as shown in FIGS. 4 and 11. This sector plate 218 is pivotably mounted to the lock body 60. A lever arm 216 is secured to the shaft 160, and this lever arm 216 is positioned to swing in a plane parallel to that of the top and bottom plates 70, 80. The lever arm 216 engages the sector plate 218 such that rotation of the sector plate 218 by the tab 214 causes the lever arm 216 and therefore the shaft 160 to be rotated. This rotation of the shaft 160 moves the keeper plate 114 out of engagement with the latch plate 100 via the linkage made up of the fork 162 and pin 122 described above.

As shown in FIG. 5, the lock plate 140 pivots about a hollow sleeve 220. The sleeve 220 defines a reduced diameter shoulder 222 at each end, and these shoulders 222 fit into receiving apertures in the top and bottom plates 70, 80. Thus, the sleeve 220 acts as a spacer which defines the minimum separation between the top and bottom plates 70, 80. A nylon washer 224 is positioned between the lock plate 140 and the top plate 70 to reduce friction, and a nylon sleeve 226 is provided around the sleeve 220 between the lock plate 140 and the bottom plate 80 in order to securely hold the lock plate 140 in the intended plane of rotation. A solid, low carbon rivet 228 passes through the hollow sleeve 220. This rivet 228 is provided with a pan head against the outer part of the top plate 70. The portion of the rivet 228 between the door 20 and the bottom plate 80 is welded in place against a washer 230 such that the rivet 228 securely holds the top and bottom plates 70, 80 together. A similar construction is used to pivotably mount both the latch plate 100 and the keeper plate 114 in place between the top and bottom plates 70, 80.

Merely by way of example, and without limiting the scope of this invention, the following construction details have been found to be suitable. In this preferred embodiment the metal components of the lock 10 are all formed of low carbon steel. All moving parts have been case hardened to a depth of 0.005–0.010 inches in order to improve their wear characteristics. A total of 10 spot welds are used to join the sections 62, 72 of the lock body 60 rigidly together to form a suitable high strength frame for the lock 10, and solid rivets formed of 10-08 low carbon steel ($\frac{1}{4}$ inch in diameter and 1 inch in length) are resistance welded in place over a steel washer in order further to strengthen the lock body 60. As shown in the drawings, in this embodiment three solid rivets are used, one passing through the pivot axis of each of the latch plate, keeper plate, and lock plate. In this embodiment, the spring 130 is stress-relieved at a temperature of 400° F.–500° F. for one hour, and it provides a holding force of about 12 pounds when the latch plate 110 and keeper plate 114 are in the positions shown in Figure 8. Nylon washers and sleeves are used between moving surfaces in order to reduce friction.

The lock 10 has been tested extensively in accordance with the test procedures set out in SAE J839b (Revised May 1965). The lock 10 meets the basic requirements of SAE J839b with regard to both longitudinal and transverse load. That is, the lock 10 is able to withstand a longitudinal load of 2,500 lbs. when in the fully latched position and 1,000 lbs. when in the secondary latched position. Furthermore, the lock 10 is able to withstand a transverse load of 2,000 lbs. when in the fully latched position and 1,000 lbs. when in the secondary latched position. The overlapping side plates 68, 78 the spot welds 84, 86, and the solid rivets 228 all contribute to the high strength of the lock 10.

From the foregoing, it should be apparent that an improved, dual action rotary lock has been described which utilizes a single latching mechanism and a single latch plate to engage either one of the front and rear strikers. For this reason, the same mechanism works to latch the sliding door in either the open or closed position. The disclosed structure is compact, reliable, and relatively inexpensive to manufacture. Furthermore, it provides a strong, reliable locking action, which provides important safety advantages. Because of the extremely narrow width of the disclosed lock, it provides the disclosed two-way locking action while allowing the sliding door to be opened widely. Thus, the lock of this invention provides reliable, dual action rotary locking without interfering with the complete opening of the door.

Of course, it should be understood that a wide range of changes and modifications can be made to the preferred embodiment described above. For example, the tangs on opposite sides of the pivot axis of the latch plate do not necessarily need to be 180° apart. Rather, the tangs should be positioned as appropriate for the intended application. Furthermore, the two tangs may be defined by separate latching plates, and the means for latching the tangs in place my include two separate latching mechanisms rather than the single mechanism shown in the drawings. It is therefore intended that the foregoing detailed description be regarded as illustrative rather than limiting, and that it be understood that it is the following claims, including all equivalents, which are intended to define the scope of this invention.

I claim:

1. A two-way rotary lock for an automotive vehicle of the type defining a door opening bounded laterally by first and second side frames, a sliding door mounted to slide between an open position, in which the door exposes the door opening, and a closed position, in which in door closes the door opening, a first striker secured to the first side frame, and a second striker secured to the second side frame, said lock comprising:

a lock body defining first and second recesses positioned on opposed sides of the lock body to receive the first and second strikers, respectively;

a first tang positioned within the lock body;

means for rotatably mounting the first tang to the lock body such that the first tang pivots in a first direction to capture a portion of the first striker which has passed through the first recess into the interior of the lock body;

a second tang positioned within the lock body;

means for rotatably mounting the second tang to the lock body such that the second tang pivots in the first direction to capture a portion of the second striker which has passed through the second recess into the interior of the lock body;

means for automatically locking the first and second tangs in place against rotation in a second direction, opposite to the first direction, to capture the first and second strikers, respectively, in the lock body; and means for selectively, manually overriding the locking means to allow rotation of the first and second tangs in the second direction to release the first and second strikers from the lock body.

2. The invention of claim 1 wherein both the first and second strikers are U-shaped and each defines a respective central bight section shaped to protrude into the lock body through the respective recess.

3. The invention of claim 1 wherein the first and second tangs are defined by a common latch plate mounted to the lock body to pivot about an axis.

4. The invention of claim 3 wherein the first and second tangs are positioned on opposed sides of the axis.

5. The invention of claim 4 wherein the lock body defines a longitudinal axis extending through the pivot axis and extending between the two recesses, perpendicular to the direction of travel of the lock when mounted to the door, and wherein the first and second recesses are offset with respect to one another along the length of the longitudinal axis, one on either side of the pivot axis.

6. The invention of claim 3 wherein the locking means comprises a keeper plate pivotably mounted on the lock body to mechanically engage the latch plate to lock the first and second tangs in place.

7. The invention of claim 6 wherein the overriding means comprises an inside handle and means for linking the inside handle to the keeper plate to rotate the keepr plate out of engagement with the latch plate when the inside handle is twisted.

8. The invention of claim 7 wherein the overriding means further comprises an outside handle and means for linking the outside handle to the keeper plate to rotate the keeper plate out of engagement with the latch plate when the outside handle is actuated.

9. The invention of claim 3 further comprising:

a lock plate pivotably mounted to the lock body and movable between a locked position, in which the latch plate is positively secured in position independently of the keeper plate, and an unlocked position, in which the lock plate is disengaged from the latch plate;

means for manually moving the lock plate between the locked and the unlocked positions.

10. a two-way rotary lock for an automotive vehicle of the type defining a door opening bounded laterally by first and second side frames, a sliding door mounted to slide between an open position, in which the door exposes the door opening, and a closed position, in which the door closes the door opening, a first striker secured to the first side frame, and a second striker secured to the second side frame, said lock comprising:

an elongated lock body which defines a transverse axis;

a latch plate mounted for rotation about a pivot axis in the lock body, said latch plate defining first and second tangs, each shaped to engage and capture a respective one of the strikers, said pivot axis positioned on the transverse axis, said first and second tangs positioned on opposite sides of the transverse axis;

means for defining first and second recesses in the lock body aligned with the first and second tangs, respectively, on opposite sides of the transverse axis to receive portions of the first and second strikers, respectively;

means for securing the latch plate in place to prevent rotation of the latch plate about the pivot axis in a selected direction to latch the first and second strikers in the lock body; and means for manually overriding the securing means to allow rotation of the latch plate in the selected direction in order to release the first and second strikers from the lock body.

11. The invention of claim 10 wherein the securing means comprises a keeper plate mounted to the lock body to mechanically engage the latch plate.

12. The invention of claim 11 wherein the overriding means comprises:

an inside handle pivotably mounted to the lock body and extending substantially perpendicularly to the transverse axis in its rest state; and means for linking the inside handle to the keeper plate such that pivotal movement of the inside handle moves the keeper plate out of engagement with the latch plate to release the first and second strikers from the lock body.

13. The invention of claim 12 wherein the overriding means further comprises:

an outside handle; and means for linking the outside handle to the keeper plate such that actuation of the outside handle moves the keeper plate out of engagement with the latch plate to release the first and second strikers from the lock body.

14. The invention of claim 11 further comprising a spring mounted between the latch plate and the keeper plate to bias them together, into engagement.

15. The invention of claim 11 further comprising:

a lock plate pivotally mounted to the lock body and movable between a locked position, in which the latch plate is positively secured in position independently of the keeper plate, and an unlocked position, in which the lock plate is disengaged from the latch plate;

means for manually moving the lock plate between the locked and the unlocked positions.

16. In combination with an automotive vehicle of the type comprising first and second spaced side frames which define a door opening therebetween; and a sliding door mounted to slide between a closed position, in which the door closes the opening, and an open position, in which the door reveals the opening; the improvement comprising:

a first rod-shaped striker secured to the first side frame adjacent to the opening;

a second rod-shaped striker secured to the second side frame adjacent to the opening;

a dual action rotary lock secured to the door, said lock comprising:

a lock frame mounted to the door and defining first and second recesses positioned to admit portions of the first and second strikers into the lock frame when the door is in the open and closed positions, respectively;

a latch plate rotatably mounted to the lock frame to pivot about an axis, said latch plate defining first and second tangs on opposed sides of the axis;

said first tang aligned with the first recess and positioned and configured to engage the first striker, rotate the latch plate in a first direction to a latched position, and thereby capture the first striker and latch the door in the open position when the door is moved to the open position;

said second tang aligned with the second recess and positioned and configured to engage the second striker, rotate the latch plate in the first direction to the latched position, and thereby capture the second striker and latch the door in the closed position when the door is moved to the closed position;

means for automatically and positively securing the latch plate in the latched position against rotation in a second direction, opposed to the first direction, in order to prevent a captured one of the first and second strikers from disengaging from the latch plate; and means for manually overriding the securing means to allow the latch plate to rotate in the second direction in order to disengage a captured one of the first and second strikers from the latch plate and thereby release the door.

17. The invention of claim 16 wherein each striker is U-shaped and defines a central bight section positioned to protrude into the lock frame through the respective recess and engage the respective tang.

18. The invention of claim 16 wherein the securing means comprises a keeper plate rotatably mounted to the frame and shaped to mechanically engage and lock the latch plate in the latched position.

19. The invention of claim 18 wherein the lock further comprises a spring mounted between the keeper plate and the latch plate to bias the latch plate in a second direction, opposed to the first direction.

20. The invention of claim 18 wherein the overriding means comprises an inside handle and means for linking the inside handle to the keeper plate to rotate the keeper plate out of engagement with the latch plate when the inside handle is twisted.

21. The invention of claim 20 wherein the overriding means further comprises an outside handle and means for linking the outside handle to the keeper plate to rotate the keeper plate out of engagement with the latch plate when the outside handle is actuated.

22. The invention of claim 18 further comprising:

a lock plate pivotably mounted to the lock frame and movable between a locked position, in which the latch plate is positively secured in the latched position independently of the keeper plate, and an unlocked position, in which the lock plate is disengaged from the latch plate;

means for manually positioning the lock plate from the side of the door on which the lock is mounted.

23. The invention of claim 16 wherein the lock ooperates with the second striker to hold the door in the closed position against a 2,500-pound force tending to slide the door to the open position.

24. The invention of claim 16 wherein the first and second strikers are offset with respect to one another along the lengths of the respective side frames.

25. The invention of claim 16 wherein the lock frame comprises an enclosed, box-like structure defined by first and second lock body sections which overlap around the entire perimeter of the box-like structure and are secured rigidly together to ensure the rigidity of the frame.

* * * * *